US005188290A

United States Patent [19]

Gebauer et al.

[11] Patent Number: 5,188,290

[45] Date of Patent: Feb. 23, 1993

[54] ELECTROSTATIC COMPRESSED AIR PAINT SPRAY GUN

[75] Inventors: Gerhard Gebauer, Bermatingen, Fed. Rep. of Germany; Johann Gruber, Rebstein, Switzerland

[73] Assignee: J. Wagner GmbH, Fed. Rep. of Germany

[21] Appl. No.: 654,342

[22] Filed: Feb. 12, 1991

[30] Foreign Application Priority Data

Feb. 16, 1990 [EP] European Pat. Off. ..... 90103066.8

[51] Int. Cl.[5] ..... B05B 5/03

[52] U.S. Cl. ..... 239/3; 239/707; 239/708; 239/132

[58] Field of Search ..... 239/3, 690, 696, 704, 239/706, 707, 708, 132–132.5

[56] References Cited

U.S. PATENT DOCUMENTS

| | | | |
|---|---|---|---|
| 3,401,883 | 9/1968 | Gebhardt et al. | 239/690 |
| 3,599,038 | 8/1971 | Skidmore . | |
| 3,938,739 | 2/1976 | Bertilsson et al. | 239/705 |
| 4,033,506 | 7/1977 | Braun . | |
| 4,196,465 | 4/1980 | Buschor . | |
| 4,245,784 | 1/1981 | Garcin | 239/708 |
| 4,287,552 | 9/1981 | Wagner et al. . | |
| 4,290,091 | 9/1981 | Malcolm . | |
| 4,323,947 | 4/1982 | Huber . | |
| 4,441,656 | 4/1984 | Huber . | |
| 4,572,437 | 2/1986 | Huber et al. | 239/703 |
| 4,651,932 | 3/1987 | Huber et al. . | |
| 4,750,676 | 6/1988 | Huber et al. . | |
| 4,752,034 | 6/1988 | Kuhn et al. . | |
| 4,775,105 | 10/1988 | Rese . | |

FOREIGN PATENT DOCUMENTS 2522991 9/1983 France .

*Primary Examiner*—Andres Kashnikow
*Assistant Examiner*—Karen B. Merritt
*Attorney, Agent, or Firm*—Hill, Steadman & Simpson

[57] ABSTRACT

In an electrostatic compressed air paint spray gun, the overall exit area of the compressed air discharge opening as well as the pressure and the quantity of the supplied compressed air are dimensioned such and matched such to one another that, first, the ratio ($V_L$) of the air pressure ($P_1$) prevailing immediately upstream of the compressed air discharge opening to the air pressure ($P_2$) prevailing downstream of the compressed air discharge opening is less than 2:1 and, second, quantity and flow rate of the compressed air emerging from the compressed air discharge opening and magnitude of the applied high-voltage guarantee an adequate atomization of the paint as well as a conveying of the atomized paint particles to the workpiece with a given paint throughput and given paint viscosity. A high precipitation efficiency and a good paint compass are thus achieved.

19 Claims, 1 Drawing Sheet

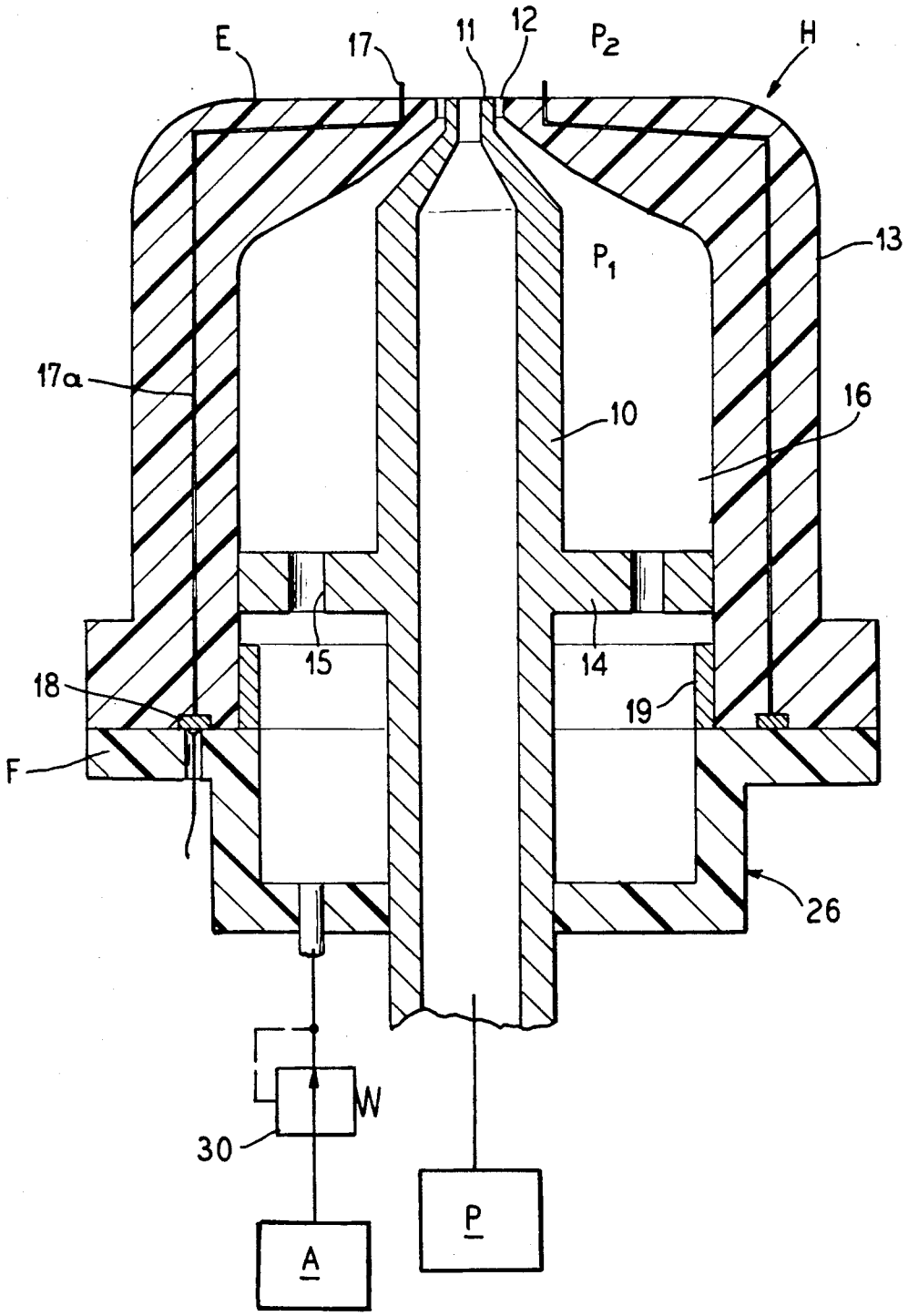
E
17
11
12
P2
H
13
P1
17a
10
16
15
14
18
19
F
26
W
30
P
A

ELECTROSTATIC COMPRESSED AIR PAINT SPRAY GUN

BACKGROUND OF THE INVENTION

The invention is directed to an electrostatic compressed air paint spray gun having a paint discharge nozzle connected to a paint delivery conduit and also having a compressed air discharge opening in the form of an apertured collar or annular gap concentrically surrounding the paint discharge nozzle. The compressed air discharge opening is connected to a compressed air delivery conduit and discharges adjacent to the paint discharge nozzle. The spray gun has an electrode arrangement connected to a high-voltage supply. Such electrostatic compressed air paint spray guns have been known for decades and are commercially available in a great variety of embodiments.

The structure of these electrostatic compressed air paint spray guns is comparatively simple. No rotatory drive and no rotating parts are required as compared to electrostatic rotation paint spray guns. The paint-carrying parts, valves and seals, are not subjected to any high pressure in contrast to airless high-pressure paint atomization because a paint pressure that guarantees a faultless conveying of the paint liquid up to the paint discharge nozzle is adequate; atomization and conveying of the paint ensue therefrom with the flowing compressed air. The compressed air is supplied by connection of the spray gun to a typical compressed air network; the pressure of approximately 6 through 8 bar usually present in these compressed air networks is fully adequate. The high-voltage for the electrodes is supplied either via a cable from a separate high-voltage generator or is generated with what is referred to as high-voltage cascades in the gun itself.

However, the excellent values for the precipitation efficiency and, in particular, for the paint compass obtained from electrostatic rotation paint spray guns generally cannot be achieved with the prior art electrostatic compressed air paint spray guns. It is recognized that one of the causes of this drawback is the higher kinetic energy of the atomized paint droplets in comparison to the rotation atomizer process of rotation paint spray guns. It has not been recognized that these disadvantages can be alleviated by controlling system parameters of compressed air atomization systems.

SUMMARY OF THE INVENTION

It is then an object of the present invention to improve an electrostatic compressed air paint spray gun of the type initially described such that, while retaining the previous advantages, i.e., structural simplicity, values for the precipitation efficiency and the compass are enhanced that were hitherto only achieved by the significantly more involved electrostatic rotation paint spray guns.

The invention is accomplished in that the overall discharge area of the compressed air discharge opening as well as the pressure and the quantity of supplied compressed air are dimensioned and matched such to one another that, first, the ratio of the absolute air pressure prevailing immediately upstream of the compressed air discharge opening to the absolute air pressure prevailing downstream of the compressed air discharge opening is less than a limit value of 2:1 and, on the other hand, quantity and flow rate of the compressed air emerging from the compressed air discharge opening and the magnitude of the applied high-voltage ensure an adequate atomization of the paint as well as a conveying of the atomized paint particles to the workpiece with a given paint throughput and a given paint viscosity.

The invention derives from the perception acquired by numerous trials that the disadvantages of previous electrostatic compressed air atomizer guns can be mainly attributed to the fact that the compressed air emerging from the apertured rim or, respectively, from the annular gap has considerable turbulence. This turbulence leads to the fact that, even when the median of the kinetic energy of the atomized paint particles or, respectively, their mean velocity, remains within limits, individual regions of the spray jet and, thus, parts of the paint particles are lent such a high speed that the appertaining particles tend to bounce back from the workpiece or fly past the workpiece (inadequate paint compass) as a consequence of their high kinetic energy. Also, because of this high speed, particularly as a consequence of their short dwell time within the corona region of the electrode arrangement, the appertaining particles are inadequately charged. As a result thereof the former effects (rebound, inadequate compass) are significantly intensified.

The invention ensures then that the compressed air emerges from its discharge opening in an essentially laminar flow, i.e., as a calm and uniform air stream. This is achieved in that spraying is carried out below the recited limit value for the relationship between the pressure proceeding and following the compressed air discharge openings, i.e., in what is referred to as the sub-sonic flow region. However, to retain effectiveness, emerging air will remain close to this limit value in order to ensure an adequate atomization of the paint and a faultless conveying of the atomized paint particles to the workpiece. In particular, an air quantity (air through the discharge openings) is ensured that is at least as high as and, under given conditions, higher than in known electrostatic compressed air atomizer guns that work with a pressure ration of, for example, 6:1.

In a further refinement of the invention, the ratio of the absolute air pressure prevailing immediately upstream of the compressed air discharge opening to the absolute air pressure prevailing downstream of the compressed discharge opening amounts to between 1.8:1 and 2:1. In a further embodiment, the delivered compressed air has a temperature above room temperature, and the spray gun has a cooling means for cooling the compressed air before discharge from the compressed air discharge opening to a temperature equal to or below room temperature. Also, the electrode arrangement comprises a plurality of electrode needles arranged in or immediately adjacent to the paint discharge opening.

BRIEF DESCRIPTION OF THE DRAWING

The figure is a schematic sectional view of a spray-side front end of an electrostatic compressed air paint spray gun.

DETAILED DESCRIPTION OF THE PREFERRED EMBODIMENTS

According to the figure, a spray-side front end of the spray gun, also referred to as a spray head, H comprises a paint delivery tube 10 that has its spray end discharging through a central paint discharge nozzle 11. The paint discharge nozzle 11 is concentrically surrounded by a compressed air discharge opening in the form of an annular gap 12 that is defined between the discharge nozzle 11 and an air cap 13. A flange 14 of the paint delivery tube 10, that is provided with bores 15, defines on a backside, between the paint delivery tube 10 and the air cap 13, an air chamber 16. The air cap 13 is composed of an electric insulating material. The paint delivery tube 10 together with nozzle 11 is preferably also manufactured of an insulating material but could also be composed of metal. Needle electrodes 17 project forwardly from an end face E of the air cap 13 forming a needle collar, concentric relative to the paint discharge nozzle 11. The needle electrodes 17 are conductively connected via lines 17*a* proceeding in the air cap 13 to a contact ring 18 situated at a back face F of the air cap 13. The spray head H shown in the drawing is seated at the front end of a gun barrel of a paint spray gun, shown schematically at 26, whereby paint is delivered into the gun 26 from a paint supply P and out of the head H via the paint delivery tube 10. The compressed air is delivered into the gun 26, then through the bores 15 and finally out of the gap 12. The high-voltage is delivered via the contact ring 18. To this extent, the shown spray head H corresponds in structure and functioning to the standard prior art.

According to the invention, however, when the paint spray gun is in operation, the absolute pressure $P_1$ of the compressed air in the air chamber 16, i.e., immediately upstream of the annular gap 12, is limited to a defined maximum value, namely such that the ratio $V_L$ of the pressure $P_1$ to the pressure $P_2$ in the front of the spray head, i.e., downstream from the annular gap 12, is below 2:1. When spraying is carried out "outside" or at ambient pressure, the pressure $P_2$ thus amounts to one bar, which means that the pressure $P_1$ must remain below two bar absolute or, respectively, below one bar overpressure. When spraying is carried out in a closed spray compartment with extraction wherein the pressure $P_2$ lies somewhat below atmospheric pressure, the pressure $P_1$ must be selected correspondingly lower.

This comparatively lower pressure in the air chamber 16 is provided, for example, by connection to a standard compressed air system A having a substantially higher pressure, with a pressure-reducing valve or valves 30 inserted into or preceding the bores 15. Another possibility of supplying this low pressure air is to supply the paint spray gun with compressed air on the basis of a motor-driven blower that delivers compressed air with a correspondingly lower pressure, for example, using what is referred to as a "vacuum cleaner motor blower". In the latter instance, however, the delivered blower air experiences a temperature elevation and, in order to prevent having the atomized paint particles "dry up" before reaching the workpiece as a result of the heated air, it is expedient to provide a cooling element, for example a cooling ring 19 as indicated in the figure.

What is critical, of course, is that the paint supplied in the tube 10 and emerging from the nozzle 11 is finely atomized and is conveyed to the workpiece despite the comparatively low pressure and the comparatively low velocity of the compressed air as a result thereof. Spraying will therefore be generally carried out close to the recited limit value, i.e., having a ratio in the range of $$1.3:1 < V_L < 2:1$$

and preferably $$1.8:1 < V_L < 2:1$$

What is thereby of decisive significance, however, is that the air quantity is adequate, i.e., the throughput or mass flow of compressed air through the annular gap 12 per time unit. Practical tests have shown that the air quantity must be just as great as or greater than the air quantity that is conveyed given the standard compressed air guns having a delivery pressure of approximately 6 bar for the compressed air. This requires a size of the throughput area of the annular gap 12 that must be considerably larger than in standard compressed air paint spray guns, for example by the factor 2 or 3. It is thereby less meaningful to specify absolute values for the air throughput quantity and/or the discharge area of the annular gap 12 because these values are dependent on the desired paint throughput and on the velocity of the paint to be sprayed; all the more energy must be offered for atomization and for conveying the paint the higher the desired paint throughput and the more viscous the paint to be sprayed. Since the increase in energy should not ensue by increasing the pressure of the compressed air—at least not above the recited limit value—this is achieved by increasing the throughput air quantity.

In practice, the pressure and quantity of delivered compressed air as well as size of the exit face of the annular gap are adapted to the maximum paint throughput of the paint spray gun given employment of the most viscous paints and thereafter the operator can adjust the spray gun given lower paint throughput and/or given more easily atomizable paints. The adjustment can be made on a basis of externally actuatable air valves, namely a pressure-reducing valve and/or a quantity-reducing valve.

The electrode arrangement can be fashioned in a standard way; however, it is expedient to arrange the electrodes in close proximity to the paint discharge, for instance as a central needle electrode in the paint discharge nozzle, in order to assure that all paint particles traverse the corona region, i.e., the region of highest field strength. It is thereby also of significance that a part of the droplet conveying energy is supplied by the electrostatic field. The magnitude of the applied voltage is therefore also a critical factor and is to be taken into consideration in the matching, particularly when spraying paints having different electrical conductivity (water lacquer).

Practical tests have shown that an unusually high precipitation efficiency is achieved with the electrostatic compressed air paint spray gun of the invention, this not only leading to cost savings but also to significantly reduced environmental contamination. Over and above this, an excellent paint compass is achieved, for instance when spraying pipes, this having been hitherto possible only with electrostatic rotation paint spray guns. The term "paint" selected here, of course, is meant to include all electrostatically sprayable coating liquids, particularly lacquers of any and all consistency.

Although the present invention has been described with reference to a specific embodiment, those of skill in the art will recognize that changes may be made thereto without departing from the scope and spirit of the invention as set forth in the appended claims.

We claim as our invention:

1. In an electrostatic compressed air paint spray gun having a spray head which receives paint and compressed air, said spray head having a liquid paint discharge nozzle connected to a paint delivery conduit, a compressed air discharge opening arranged concentrically surrounding the liquid paint discharge nozzle and connected to a compressed air delivery conduit, said compressed air discharge opening capable of discharging a continuous quantity of compressed air adjacent to the liquid paint discharge nozzle for atomizing and transporting said paint during spraying, said spray head also having an electrode arrangement connected to a high voltage supply, and arranged adjacent to the liquid paint discharge opening, the improvement comprising the overall discharge area of the compressed air discharge opening being dimensioned to pass said continuous quantity of compressed air from the compressed air delivery conduit to the outside atmosphere wherein the ratio of the absolute air pressure prevailing immediately upstream of the compressed air discharge opening to the absolute air pressure prevailing downstream of the compressed air discharge opening is less than 2:1, and wherein said liquid paint discharge nozzle and said air discharge opening open directly to the atmosphere in front of said spray head.

2. The improvement of claim 1, wherein the ratio of the absolute air pressure prevailing immediately upstream of the compressed air discharge opening to the absolute air pressure prevailing downstream of the compressed air discharge opening is between 1.3:1 and 2:1.

3. The improvement of claim 1, wherein the ratio of the absolute air pressure prevailing immediately upstream of the compressed air discharge opening to the absolute air pressure prevailing downstream of the compressed air discharge opening is between 1.8:1 and 2:1.

4. The improvement of claim 1, wherein the electrode arrangement comprises a plurality of electrode needles arranged adjacent to the liquid paint discharge opening.

5. In an electrostatic compressed air paint spray gun having a spray head which receives paint and compressed air, said spray head having a paint discharge nozzle connected to a paint delivery conduit, a compressed air discharge opening arranged concentrically surrounding the paint discharge nozzle and connected to a compressed air delivery conduit, said compressed air discharge opening capable of discharging a continuous quantity of compressed air adjacent to the paint discharge nozzle for atomizing and transporting said paint during spraying, said spray head also having an electrode arrangement, connected to a high voltage supply, and arranged adjacent to the paint discharge opening, the improvement comprising the overall discharge area of the compressed air discharge opening being dimensioned to pass said continuous quantity of compressed air from the compressed air delivery conduit to the outside atmosphere wherein the ratio of the absolute air pressure prevailing immediately upstream of the compressed air discharge opening to the absolute air pressure prevailing downstream of the compressed air discharge opening is less than 2:1; and wherein the compressed air delivered to the spray gun has a temperature above room temperature, and the spray gun further comprises a cooling means for cooling the compressed air before discharge of the compressed air through the compressed air discharge opening, to a temperature at least as low as room temperature.

6. An electrostatic compressed air material spray gun receiving a supply of liquid material to be sprayed which is capable of providing a desired flow rate of material therefrom, and receiving a supply of compressed air at a first pressure which is capable of providing a select continuous quantity of pressurized air therefrom, comprising:

a liquid material discharge nozzle mounted at a terminal spraying end of said gun and opening directly to the atmosphere in front of said terminal spraying end;

a liquid material delivery conduit, connected for flow to said liquid material discharge nozzle, receiving said flow rate from said supply of liquid material, for delivering liquid material to be sprayed to said liquid material discharge nozzle;

a compressed air delivery conduit receiving said select continuous quantity of pressurized air and having a discharge opening at said terminal spraying end of said gun opening directly to the atmosphere in front of said terminal spraying end, said opening surrounding said liquid material discharge nozzle;

means for delivering said select continuous quantity of pressurized air through said compressed air discharge opening from said compressed air delivery conduit and for controlling the ratio of the absolute air pressure prevailing immediately upstream of the compressed air discharge opening to the absolute air pressure prevailing downstream of the compressed air discharge opening to less than 2:1, said select continuous quantity of pressurized air sufficient to atomize and transport said desired flow rate of material to be sprayed.

7. An electrostatic compressed air material spray gun according to claim 6, wherein said means for delivering and controlling comprises the compressed air discharge opening being selectively dimensioned to pass the select continuous quantity of pressurized air with a restriction orifice-type pressure drop across said compressed air discharge opening equivalent to the air pressure prevailing immediately upstream of the compressed air discharge opening minus the air pressure prevailing downstream of the compressed air discharge opening; and said means for delivering and controlling comprises means for dropping said first pressure of said pressurized air delivered into said compressed air delivery conduit to a pressure equal to the air pressure prevailing immediately upstream of the compressed air discharge opening.

8. An electrostatic compressed air material spray gun according to claim 7, wherein said means for delivering and controlling controls the ratio of the absolute air pressure prevailing immediately upstream of the compressed air discharge opening to the absolute air pressure prevailing downstream of the compressed air discharge opening to between 1.3:1 and 2:1.

9. An electrostatic compressed air material spray gun according to claim 8, wherein said means for delivering and controlling controls the ratio of the absolute air pressure prevailing immediately upstream of the compressed air discharge opening to the absolute air pressure prevailing downstream of the compressed air discharge opening to between 1.8:1 and 2:1.

10. An electrostatic compressed air material spray gun according to claim 7, wherein said means for dropping comprises at least one valve in flow communication with said compressed air delivery conduit.

11. An electrostatic compressed air material spray gun according to claim 6, wherein said absolute air pressure prevailing immediately upstream of the compressed air discharge opening is substantially equivalent to said first pressure of said supply of compressed air.

12. An electrostatic compressed air material spray gun according to claim 11, wherein said means for delivering and controlling controls the ratio of the absolute air pressure prevailing immediately upstream of the compressed air discharge opening to the absolute air pressure prevailing downstream of the compressed air discharge opening to between 1.3:1 and 2:1.

13. An electrostatic compressed air material spray gun according to claim 11, wherein said means for delivering and controlling controls the ratio of the absolute air pressure prevailing immediately upstream of the compressed air discharge opening to the absolute air pressure prevailing downstream of the compressed air discharge opening to between 1.8:1 and 2:1.

14. An electrostatic compressed air material spray gun receiving a supply of liquid material to be sprayed which is capable of providing a desired flow rate of material therefrom, and receiving a supply of compressed air at a first pressure which is capable of providing a select continuous quantity of pressurized air therefrom, comprising:

a material discharge nozzle mounted at a spraying end of said gun;

a material delivery conduit, connected for flow to said material discharge nozzle, receiving said flow rate from said supply of liquid material, for delivering material to be sprayed to said material discharge nozzle;

a compressed air delivery conduit receiving said select continuous quantity of pressurized air and having a discharge opening surrounding said material discharge nozzle;

means for delivering said select continuous quantity of pressurized air through said compressed air discharge opening from said compressed air delivery conduit and for controlling the ratio of the absolute air pressure prevailing immediately upstream of the compressed air discharge opening to the absolute air pressure prevailing downstream of the compressed air discharge opening to less than 2:1, said select continuous quantity of pressurized air sufficient to atomize and transport said desired flow rate of material to be sprayed;

wherein said means for delivering and controlling comprises the compressed air discharge opening being selectively dimensioned to pass the select continuous quantity of pressurized air with a restriction orifice-type pressure drop across said compressed air discharge opening equivalent to the air pressure prevailing immediately upstream of the compressed air discharge opening minus the air pressure prevailing downstream of the compressed air discharge opening;

said means for delivering and controlling comprises means for dropping said first pressure of said pressurized air delivered into said compressed air delivery conduit to a pressure equal to the air pressure prevailing immediately upstream of the compressed air discharge opening; and wherein the compressed air delivered into said compressed air delivery conduit has a temperature above room temperature, and said spray gun further comprises a cooling means for cooling the compressed air before discharge of the compressed air from the compressed air discharge opening, to a temperature at least as low as room temperature.

15. An electrostatic compressed air material spray gun receiving a supply of liquid material to be sprayed which is capable of providing a desired flow rate of material therefrom, and receiving a supply of compressed air at a first pressure which is capable of providing a select continuous quantity of pressurized air therefrom, comprising:

a material discharge nozzle mounted at a spraying end of said gun;

a material delivery conduit, connected for flow to said material discharge nozzle, receiving said flow rate from said supply of liquid material, for delivering material to be sprayed to said material discharge nozzle;

a compressed air delivery conduit receiving said select continuous quantity of pressurized air and having a discharge opening surrounding said material discharge nozzle;

means for delivering said select continuous quantity of pressurized air through said compressed air discharge opening from said compressed air delivery conduit and for controlling the ratio of the absolute air pressure prevailing immediately upstream of the compressed air discharge opening to the absolute air pressure prevailing downstream of the compressed air discharge opening to less than 2:1, said select continuous quantity of pressurized air sufficient to atomize and transport said desired flow rate of material to be sprayed;

wherein said absolute air pressure prevailing immediately upstream of the compressed air discharge opening is substantially equivalent to said first pressure of said supply of compressed air; and wherein the compressed air delivered into said compressed air delivery conduit has a temperature above room temperature, and said spray gun further comprises a cooling means for cooling the compressed air before discharge of the compressed air from the compressed air discharge opening, to a temperature at least as low as room temperature.

16. A method for using an electrostatic compressed air material spray gun having a spray head which receives material and compressed air, said spray head having a liquid material discharge nozzle connected to a liquid material delivery conduit, a compressed air discharge opening arranged concentrically surrounding the liquid material discharge nozzle and connected to a compressed air delivery conduit, said compressed air discharge opening capable of discharging a sufficient continuous quantity of compressed air adjacent to the liquid material discharge nozzle for atomizing and transporting said liquid material during spraying, said spray head also having an electrode arrangement, connected to a high voltage supply, and arranged adjacent to the liquid material discharge opening, the method comprising the steps of:

delivering said liquid material directly to the atmosphere in front of said spray head;

delivering said compressed air directly to the atmosphere in front of said spray head to atomize said liquid material in front of said spray head;

during spraying, maintaining the ratio of the absolute air pressure prevailing immediately upstream of the compressed air discharge opening to the absolute air pressure prevailing downstream of the compressed air discharge opening to less than 2:1;

maintaining a flow rate of said sufficient continuous quantity of compressed air through said compressed air discharge opening; and maintaining said electrode arrangement at a sufficient voltage to adequately charge said liquid material to be sprayed.

17. A method according to claim 16 comprising the further step of, during spraying, maintaining the ratio of the absolute air pressure prevailing immediately upstream of the compressed air discharge opening to the absolute air pressure prevailing downstream of the compressed air discharge opening between 1.3:1 and 2:1.

18. A method according to claim 16 comprising the further step of, during spraying, maintaining the ratio of the absolute air pressure prevailing immediately upstream of the compressed air discharge opening to the absolute air pressure prevailing downstream of the compressed air discharge opening between 1.8:1 and 2:1.

19. A method for using an electrostatic compressed air material spray gun having a spray head which received material and compressed air, said spray head having a material discharge nozzle connected to a material delivery conduit, a compressed air discharge opening arranged concentrically surrounding the material discharge nozzle and connected to a compressed air delivery conduit, said compressed air discharge opening capable of discharging a sufficient continuous quantity of compressed air adjacent to the material discharge nozzle for atomizing and transporting said material during spraying, said spray head also having an electrode arrangement, connected to a high voltage supply, and arranged adjacent to the material discharge opening, the method comprising the steps of:

during spraying, maintaining the ratio of the absolute air pressure prevailing immediately upstream of the compressed air discharge opening to the absolute air pressure prevailing downstream of the compressed air discharge opening to less than 2:1;

maintaining a flow rate of said sufficient continuous quantity of compressed air through said compressed air discharge opening; and maintaining said electrode arrangement at a sufficient voltage to adequately charge said material to be sprayed; and cooling said select continuous quantity of compressed air before said select quantity passes through said compressed air discharge opening.

* * * * *